US011726421B2

(12) United States Patent
Tanaka et al.

(10) Patent No.: US 11,726,421 B2
(45) Date of Patent: Aug. 15, 2023

(54) IMAGE FORMING APPARATUS

(71) Applicant: CANON KABUSHIKI KAISHA, Tokyo (JP)

(72) Inventors: Sumito Tanaka, Tokyo (JP); Masahiro Tsujibayashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/824,743

(22) Filed: May 25, 2022

(65) Prior Publication Data

US 2022/0382199 A1 Dec. 1, 2022

(30) Foreign Application Priority Data

May 28, 2021 (JP) ..... 2021-089702

(51) Int. Cl.
*G03G 15/00* (2006.01)

(52) U.S. Cl.
CPC ..... *G03G 15/50* (2013.01); *G03G 15/5058* (2013.01); *G03G 15/5062* (2013.01)

(58) Field of Classification Search
CPC .. G03G 15/50; G03G 15/043; G03G 15/5058; G03G 15/5062; G03G 15/5054
See application file for complete search history.

(56) References Cited

U.S. PATENT DOCUMENTS

2017/0038717 A1* 2/2017 Oki ..... G03G 15/50
2017/0041510 A1 2/2017 Sakatani
2018/0348684 A1* 12/2018 Itagaki ..... G03G 15/5058

* cited by examiner

*Primary Examiner* — Sandra Brase
(74) *Attorney, Agent, or Firm* — Canon U.S.A., Inc. I.P. Division

(57) ABSTRACT

An image forming apparatus includes an image forming unit configured to form an image on an image carrier, a transfer unit configured to transfer the image from the image carrier to a sheet, a reader configured to read a pattern image on the sheet while conveying the sheet, a sensor configured to measure a measuring image on the image carrier, and a controller configured to control the image forming unit to form the pattern image and the measuring image while forming images on a plurality of sheets, control the reader to read the pattern image, control the sensor to measure the measuring image, and generate an image forming condition based on a result of reading the pattern image by the reader and a result of measuring the measuring image by the sensor.

9 Claims, 12 Drawing Sheets

FIG.9A

| | i = 1 | i = 2 | i = 3 | i = 4 | i = 5 | i = 6 | i = 7 | i = 8 | i = 9 | i = 10 |
|---|---|---|---|---|---|---|---|---|---|---|
| SIGNAL | 0 | 16 | 32 | 64 | 86 | 104 | 128 | 176 | 224 | 255 |
| Fa | 10 | 20 | 30 | 40 | 50 | 60 | 70 | 80 | 90 | 90 |
| Fb | 90 | 80 | 70 | 60 | 50 | 40 | 30 | 20 | 10 | 10 |

FIG.9B

| | i = 1 | i = 2 | i = 3 | i = 4 | i = 5 | i = 6 | i = 7 | i = 8 | i = 9 | i = 10 |
|---|---|---|---|---|---|---|---|---|---|---|
| SIGNAL | 0 | 16 | 32 | 64 | 86 | 104 | 128 | 176 | 224 | 255 |
| Fa | 70 | 70 | 70 | 70 | 70 | 70 | 70 | 70 | 70 | 70 |
| Fb | 30 | 30 | 30 | 30 | 30 | 30 | 30 | 30 | 30 | 30 |

FIG.12

| | RANGE | B > 1.75 | 1.7 < B ≤ 1.75 | 1.65 < B ≤ 1.7 | 1.6 < B ≤ 1.65 | B < 1.6 |
|---|---|---|---|---|---|---|
| T1 | CORRECTION AMOUNT | -1 | 0 (NO CORRECTION) | 0 (NO CORRECTION) | +1 | +2 |
| T2 | CORRECTION AMOUNT | -2 | -1 | 0 (NO CORRECTION) | 0 (NO CORRECTION) | +1 |
| T0 | CORRECTION AMOUNT | -2 | -1 | 0 (NO CORRECTION) | +1 | +2 |

IMAGE FORMING APPARATUS

BACKGROUND

Field of the Disclosure

The present disclosure relates to density control of images formed by an image forming apparatus.

Description of the Related Art

A full-color image forming apparatus employing the electrophotographic method performs image formation by forming an electrostatic latent image on a photosensitive member, developing the electrostatic latent image, transferring the image to a sheet, and fixing the transferred image to the sheet. The image density of the image formed on the sheet can be changed by environmental conditions (temperature, humidity, etc.) or degradation of the developer used for development. Thus, the image forming apparatus forms test images for evaluating the image density, adjusts image forming conditions based on a result of reading the test images by a sensor, and generates a gradation correction table to stabilize the image density. The process is referred to as calibration. The calibration is performed in two different ways. One way is to perform the calibration based on a result of reading the test images formed on a sheet. The other way is to perform the calibration based on a result of reading the test images on an image carrier before being transferred to the sheet.

The technique discussed in United States Patent Application Publication No. 2017/0041510 A1 reads test images formed on the same sheet as an image corresponding to a user instruction (user image) by using an inline sensor provided on the downstream side of a fixing unit in a case where calibration using a sheet is performed. The image forming apparatus discussed in United States Patent Application Publication No. 2017/0041510 A1 is subjected to the calibration so that the density of the test images to be printed on a sheet becomes a target density. Thus, the image forming apparatus is considered to be able to control the image density with higher accuracy than that in the case of reading the test images on an image carrier. The test images are formed in marginal regions where no user image is formed. The marginal regions are outer edge regions of the sheet to be cut off. Since the image forming apparatus is subjected to the calibration without the image forming operation thereof being interrupted, downtime can be restrained.

SUMMARY

According to an aspect of the present disclosure, an image forming apparatus includes an image carrier, an image forming unit configured to form an image on the image carrier, a transfer unit configured to transfer the image from the image carrier to a sheet, a reader configured to read a pattern image on the sheet while conveying the sheet, a sensor configured to measure a measuring image on the image carrier, and a controller configured to control the image forming unit to form the pattern image and the measuring image while forming a plurality of images on a plurality of sheets, control the reader to read the pattern image, control the sensor to measure the measuring image, generate an image forming condition based on a result of reading the pattern image by the reader and a result of measuring the measuring image by the sensor, and control image forming by the image forming unit based on the image forming condition, wherein the measuring image is formed in a region on the image carrier between a first image included in the plurality of images and a second image following the first image included in the plurality of images.

Further features of the present disclosure will become apparent from the following description of exemplary embodiments with reference to the attached drawings.

BRIEF DESCRIPTION OF THE DRAWINGS

FIGS. 9A and 9B are tables illustrating the ratios of feedback coefficients.

FIG. 12 is a schematic view illustrating a correction amount determination table for determining the correction amount of the exposure intensity.

DESCRIPTION OF THE EMBODIMENTS

Figure 1:
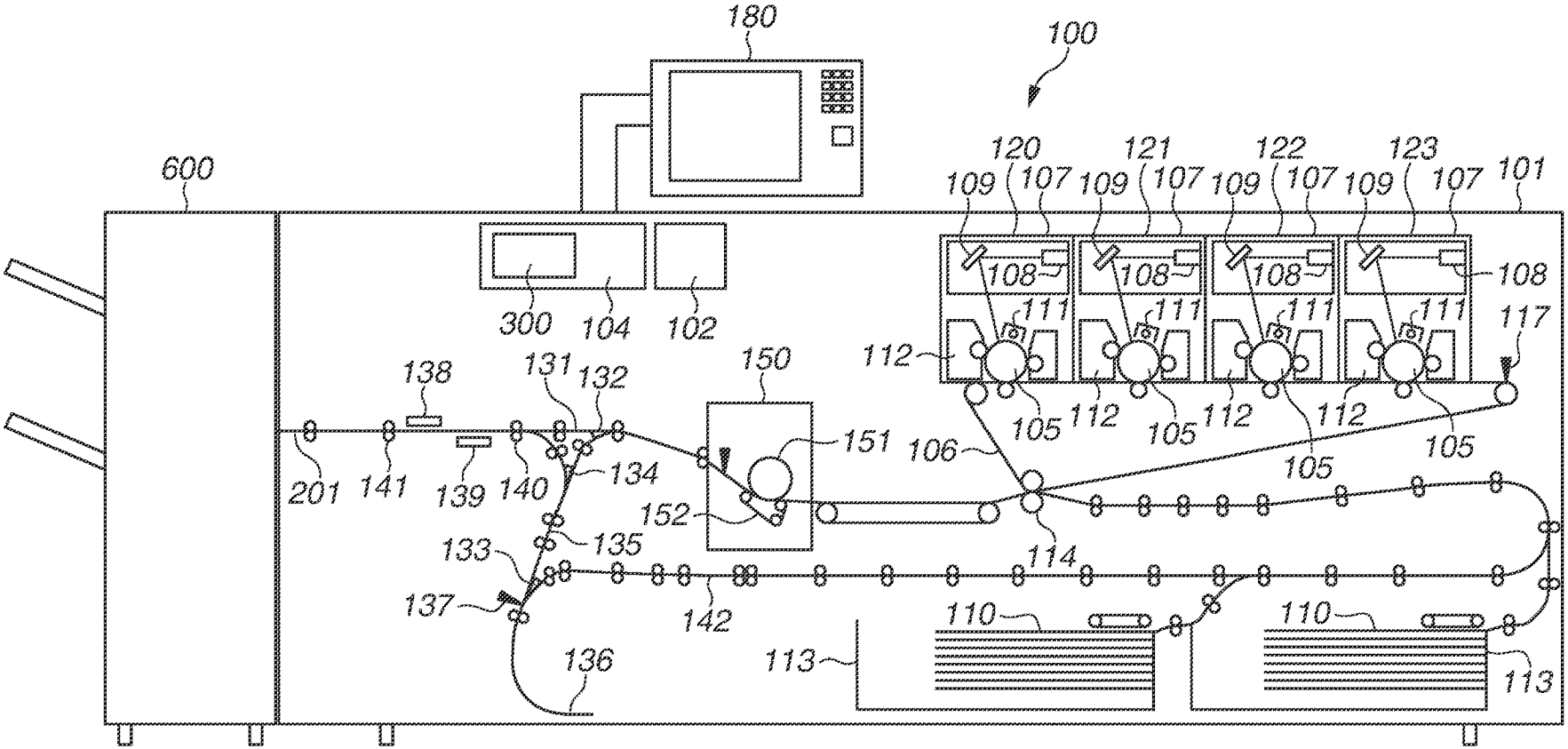
FIG. 1 is a schematic cross-sectional view illustrating an image forming apparatus.

FIG. 1 is a schematic cross-sectional view illustrating an image forming apparatus 100. The image forming apparatus 100 includes a printer 101 and a processing apparatus 600. The image forming apparatus 100 (printer 101) forms an image on a sheet 110 through an electrophotographic process. The printer 101 according to a first exemplary embodiment may be an ink jet printer or a sublimation type printer.

In the image forming apparatus 100, the printer 101 includes mechanisms that constitute an engine unit for image formation, an engine control unit 102 that controls the operation of each mechanism, and a control board storage unit 104 that stores a printer controller 300. An operation panel 180 is provided on the top surface of the printer 101. The operation panel 180 is a user interface provided with an input apparatus that accepts user instructions, and an output apparatus that displays a screen such as an operation screen. The input apparatus includes various keys and buttons, and a touch panel. The output apparatus includes a display and a speaker.

Each mechanism constituting the engine unit includes a charge/exposure processing mechanism, a development processing mechanism, a transfer processing mechanism, a fixing processing mechanism, a paper feed processing mechanism for the sheet 110, and a conveyance processing mechanism for the sheet 110. The charge/exposure processing mechanism forms an electrostatic latent image by scanning with a laser beam. The development processing mechanism visualizes the electrostatic latent image. The transfer processing mechanism transfers a toner image generated by the visualization to the sheet 110. The fixing processing mechanism fixes the toner image transferred to the sheet 110.

The mechanisms include image forming units 120, 121, 122, and 123, an intermediate transfer member 106, a fixing unit 150, and a sheet cassette 113 in the printer 101. The image forming units 120, 121, 122, and 123 each have a similar configuration that performs a similar operation to form an image of a different color. The image forming unit 120 forms a yellow (Y) image. The image forming unit 121 forms a magenta (M) image. The image forming unit 122 forms a cyan (C) image. The image forming unit 123 forms a black (K) image. The image forming units 120, 121, 122, and 123 each include a photosensitive drum 105, a charging unit 111, a laser scanner 107, and a developing unit 112.

The charge/exposure processing mechanism uniformly charges the surface of the photosensitive drum 105 by using the charging unit 111 and forms an electrostatic latent image on the surface of the photosensitive drum 105 by using the laser scanner 107. The photosensitive drum 105 is a drum-shaped photosensitive member having a photosensitive layer on the surface, and rotates about a drum axis.

The charging unit 111 uniformly charges the photosensitive layer on the surface of the rotating photosensitive drum 105.

The laser scanner 107 includes a light emission unit 108 that deflects a laser beam emitted from a semiconductor laser, in one direction, and a reflecting mirror 109 that reflects the laser beam from the light emission unit 108 toward the photosensitive drum 105. The laser scanner 107 includes a laser driver that drives the laser beam emitted from the light emission unit 108 based on image data supplied from the printer controller 300. The laser beam emitted from the semiconductor laser is deflected in one direction depending on rotation of a rotary polygon mirror in the light emission unit 108. The photosensitive drum 105 is irradiated with the laser beam deflected in one direction via the reflecting mirror 109. Thus, the surface of the photosensitive drum 105 is scanned with the laser beam in one direction (drum axial direction) to form an electrostatic latent image.

The development processing mechanism visualizes the electrostatic latent image using toner supplied from the developing unit 112, and forms a toner image on the photosensitive drum 105. The toner image on the photosensitive drum 105 is transferred to the intermediate transfer member 106. At the time of color image formation, the toner images are sequentially transferred from the photosensitive drums 105 of the image forming units 120, 121, 122, and 123 for respective colors to the intermediate transfer member 106 in a superimposed manner. In the present exemplary embodiment, the intermediate transfer member 106 rotates clockwise in FIG. 1, and the toner images are sequentially transferred from the image forming unit 120 (yellow), the image forming unit 121 (magenta), the image forming unit 122 (cyan), and the image forming unit 123 (black) in this order. Thus, a full-color toner image (visible image) is formed on the intermediate transfer member 106. The photosensitive drum 105 and the developing unit 112 are attachable to and detachable from a housing of the printer 101.

The transfer processing mechanism transfers the visible image (toner image) formed on the intermediate transfer member 106 to the sheet 110 fed from the sheet cassette 113. The transfer processing mechanism includes a transfer roller 114 to transfer the toner image from the intermediate transfer member 106 to the sheet 110. A transfer unit for transferring the toner image to the sheet 110 is not limited to the transfer roller 114 but may be a transfer blade having a blade shape applied with a transfer voltage. The toner images transferred from the image forming units 120, 121, 122, and 123 to the intermediate transfer member 106 are conveyed to the transfer roller 114 by clockwise rotation of the intermediate transfer member 106 in FIG. 1. The sheet 110 is conveyed to the transfer roller 114 in synchronization with the timing when the toner images are conveyed to the transfer roller 114. The transfer roller 114 brings the sheet 110 into pressure contact with the intermediate transfer member 106. At the same time, when the transfer roller 114 is applied with a bias voltage having polarity opposite to that of the toner image, the transfer roller 114 transfers the toner image to the sheet 110. The paper feed processing mechanism includes the sheet cassette 113 that stores the sheet 110, a conveyance path that feeds the sheet 110, and various rollers that convey the sheet 110. The sheet 110 is supplied from a sheet cassette 113 and conveyed to the transfer roller 114 through the conveyance path.

The sheet 110 with a toner image transferred thereon is conveyed to the fixing processing mechanism. The fixing processing mechanism according to the present exemplary embodiment includes the fixing unit 150. The fixing unit 150 includes a fixing roller 151 that heats the sheet 110 to fix the toner image to the sheet 110 by heat, and a pressurization belt 152 that brings the sheet 110 into pressure contact with the fixing roller 151. The fixing roller 151 is a hollow roller incorporating a heater and is configured to rotate to convey the sheet 110. The pressurization belt 152 brings the sheet 110 into pressure contact with the fixing roller 151.

The sheet 110 with an image fixed thereto by the fixing unit 150 is conveyed to a conveyance path 131 or conveyed to a conveyance path 135. A flapper 132 guides the sheet 110 to either the conveyance path 131 or the conveyance path 135. When the sheet 110 with an image fixed thereto is to be discharged face up, the flapper 132 guides the sheet 110 to the conveyance path 131. On the other hand, when the sheet 110 with an image fixed thereto is to be discharged face down, the flapper 132 guides the sheet 110 to the conveyance path 135. When double-sided printing is specified, the flapper 132 guides the sheet 110 with an image fixed to the first surface to the conveyance path 135.

Then, the sheet 110 is conveyed from the conveyance path 131 or 135 to a sheet conveyance path 201 for conveyance toward the processing apparatus 600. Conveyance rollers 140 and 141 convey the sheet 110 along the conveyance path 201. The conveyance path 201 is provided with line sensors 138 and 139 that function as readers for reading the image of the sheet 110.

Each of the line sensors 138 and 139 is an optical sensor such as a complementary metal oxide semiconductor (CMOS) sensor or a charge coupled device (CCD) sensor. The line sensor 138 reads one surface of the sheet 110, and the line sensor 139 reads the other surface of the sheet 110. The line sensors 138 and 139 read images formed on the sheet 110 that is conveyed on the conveyance path 201 by the conveyance rollers 140 and 141. Each of the line sensors 138 and 139 outputs a read signal including luminance values of the red (R), green (G), and blue (B) colors as a result of reading. These luminance values in the read signal are converted into density values of the cyan (C), magenta (M), yellow (Y), and black (K) colors. Generally, a density value A of cyan is calculated based on the luminance value of a red sensor, the density value A of magenta is calculated based on the luminance value of a green sensor, the density value A of yellow is calculated based on the luminance value of a blue sensor, and the density value A of black is calculated based on the luminance value of the green sensor. In this case, the luminance value is converted into the density value A by using a Look Up Table (LUT) 1 that is generated by acquiring a relation between the red, green, and blue (RGB) luminance values and the cyan, magenta, yellow, and black (CMYK) density values in advance. The LUT 1 is prestored in a memory in the image forming apparatus 100.

The conveyance path 135 is a path for conveying the sheet 110 to a reversing path 136 used to reverse the front and rear surfaces of the sheet 110. The reversing path 136 is provided with a reversing sensor 137 that detects the sheet 110. When the reversing sensor 137 detects the trailing end of the sheet 110, a conveyance direction of the sheet 110 is reversed in the reversing path 136. The sheet 110 of which the conveyance direction has been reversed is conveyed to either the conveyance path 135 or a conveyance path 142. Thus, a flapper 133 is provided at a branch point of the conveyance path 135 and the conveyance path 142. When the sheet 110 is conveyed to the conveyance path 135, the sheet 110 is guided to the conveyance path 135 by the flapper 133 and then further guided to the conveyance path 201 by a flapper 134. Thus, the front and back surfaces of the sheet 110 are reversed (the surface with an image formed thereon faces downward), and then the sheet 110 is discharged from the printer 101 to the processing apparatus 600. When the sheet 110 is conveyed to the conveyance path 142, the sheet 110 is guided to the conveyance path 142 by the flapper 133. When the sheet 110 is guided to the conveyance path 142, the front and back surfaces thereof are reversed. Then, the sheet 110 is conveyed to the transfer roller 114 again. Thus, the back side of the sheet 110 is subjected to image formation.

(Image Density Sensor)

An image density sensor 117 is provided on the downstream side of the image forming unit 123 in the rotational direction of the intermediate transfer member 106. The image density sensor 117 is used to measure image density of test images 1061 (FIG. 5) formed on the intermediate transfer member 106 during image density control. The intermediate transfer member 106 functions as an image carrier on which toner images and the test images 1061 are formed.

Figure 2:
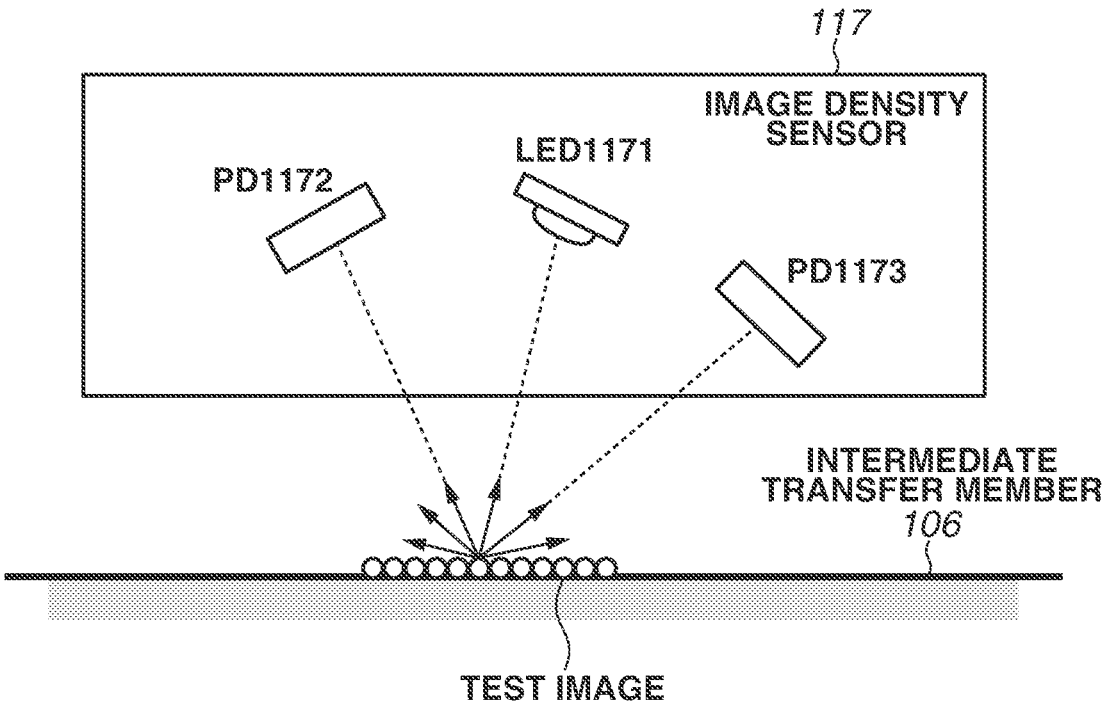
FIG. 2 is a schematic view illustrating an essential part of an image density sensor.

FIG. 2 illustrates a configuration of the image density sensor 117. As described above, the image density sensor 117 detect the test images 1061 (FIG. 5) formed on the intermediate transfer member 106. The image density sensor 117 includes an optical sensor including a light emitting diode (LED) 1171 that is a light source and light receiving units 1172 and 1173, and an electric substrate (not illustrated) with the optical sensor mounted thereon. The light receiving units 1172 and 1173 are, for example, photodiodes.

The LED 1171 irradiates the intermediate transfer member 106 with infrared light at a predetermined incidence angle (15 degrees). The light receiving unit 1172 receives reflected light of the light emitted to the intermediate transfer member 106 and the test images 1061 (FIG. 5) from the LED 1171, at the position of the regular reflection angle. The light receiving unit 1173 receives diffuse-reflected light of the reflected light of the light emitted to the intermediate transfer member 106 and the test images 1061 (FIG. 5) from the LED 1171. The electric substrate is mounted with a drive circuit that supplies a current to the LED 1171 to turn it on, and a light receiving circuit having an I-V conversion function of converting a current generated based on a light quantity of the reflected light received by the light receiving units 1172 and 1173 into a voltage.

Figure 5:
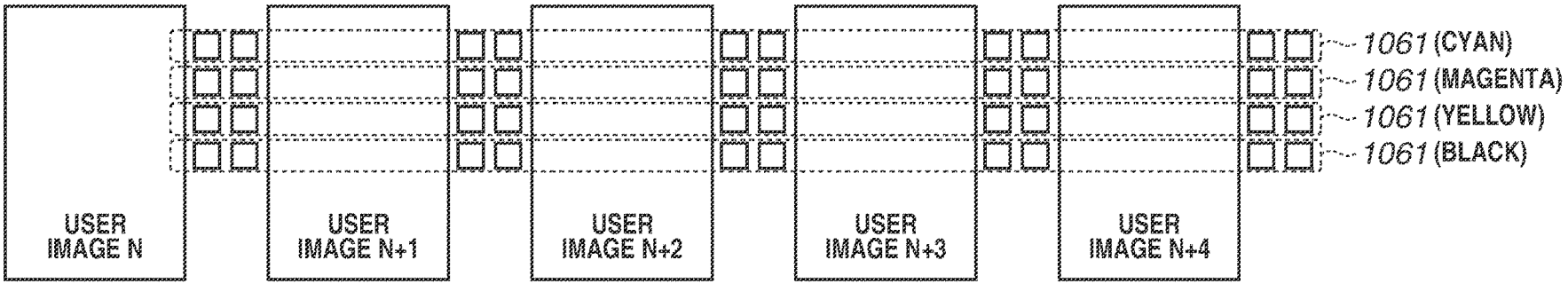
FIG. 5 is a schematic view illustrating user images and test images formed on an intermediate transfer member.

The image density sensor 117 having the above-described configuration is capable of measuring both specular reflected light and diffuse-reflected light. The light receiving unit 1172 that receives specular reflected light measures reflected light from the intermediate transfer member 106. The light receiving unit 1173 that receives diffuse-reflected light measures reflected light from the test images 1061 (FIG. 5).

The voltage output from the image density sensor 117 is input to the engine control unit 102 (FIG. 1). The engine control unit 102 (FIG. 1) converts the output voltage corresponding to a result of measuring the test images 1061 (FIG. 5) into a density value.

In this case, for the test image 1061 (FIG. 5) of the black toner, the output voltage based on a result of light reception by the light receiving unit 1172 is converted into a density value. For the test images 1061 (FIG. 5) of the cyan, magenta, and yellow toners, the output voltage based on a result of light reception by the light receiving unit 1173 is converted into a density value. The engine control unit 102 (FIG. 1) converts the result of measuring the test images 1061 (FIG. 5) into a density value by using a LUT 2 for converting the output voltage into a density value.

The image density sensor 117 is not limit to the configuration according to the present exemplary embodiment. For example, in the light receiving unit 1173, the optical axis for reflected light reception may be disposed in the normal direction with respect to the surface of the intermediate transfer member 106 where the test images 1061 (FIG. 5) are formed. The light receiving units 1172 and 1173 may each include a polarized filter.

(Printer Controller)

Figure 3:
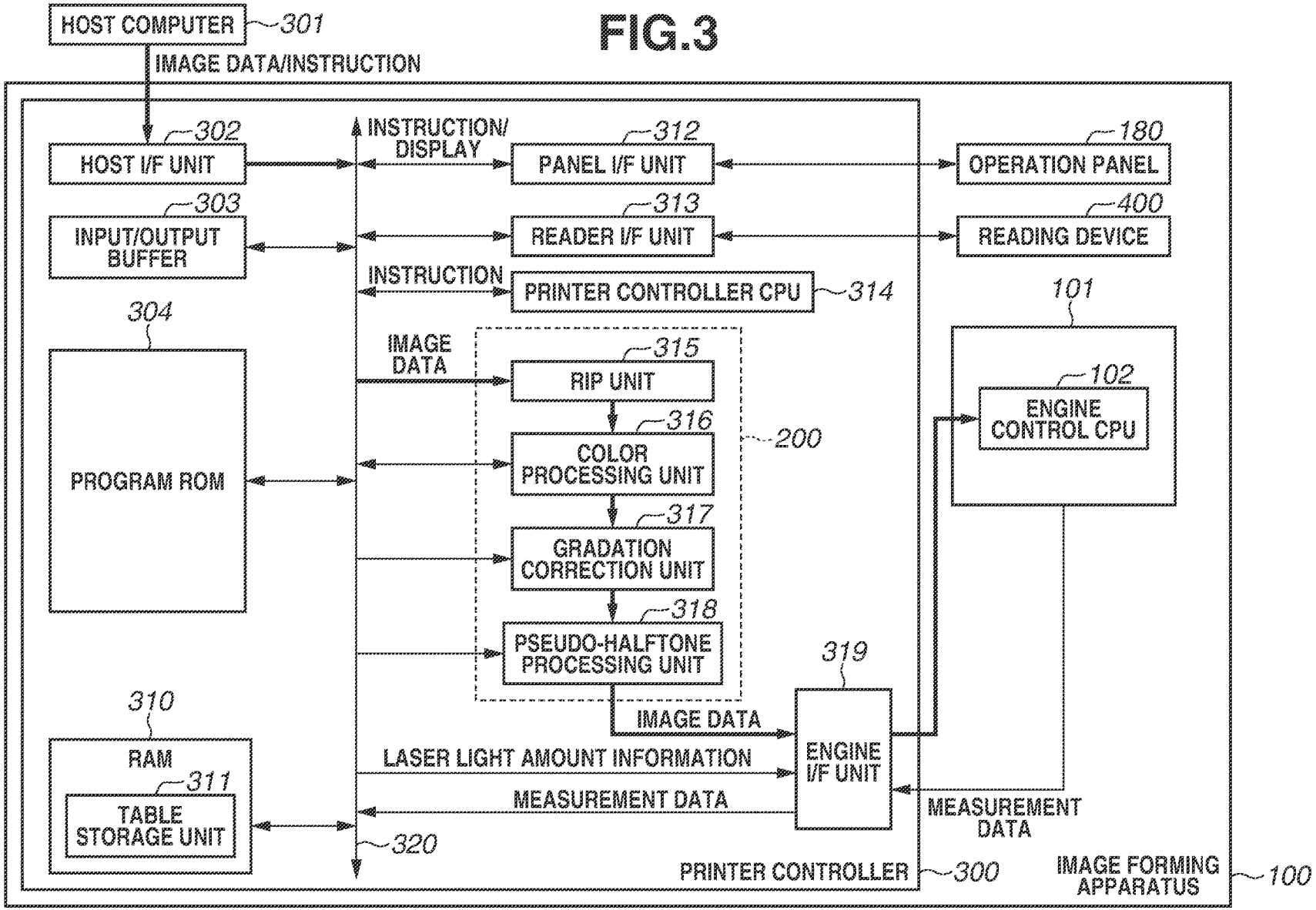
FIG. 3 is a control block diagram illustrating the image forming apparatus.

FIG. 3 is a control block diagram illustrating the image forming apparatus 100. The printer controller 300 is communicably connected to a host computer 301 that is an apparatus provided outside the image forming apparatus 100. The host computer 301 and the image forming apparatus 100 are communicably connected with each other via a communication line, such as Universal Serial Bus (USB) 2.0 High-Speed, 1000Base-T, 100Base-TX, and 10Base-T (conforming to Institute of Electrical and Electronics Engineers (IEEE) 802.3), or are wirelessly connected with each other. The printer controller 300 is communicably connected with a reading device 400 that is an apparatus provided outside the image forming apparatus 100.

The printer controller 300 controls the overall operation of the image forming apparatus 100. Thus, the printer controller 300 is connected with the operation panel 180 and the printer 101. The printer 101 includes the engine control unit 102 that controls the operation of each mechanism in the printer 101 in response to instructions from the printer controller 300 to perform image forming processing on the sheet 110.

The engine control unit 102 transmits the result of measuring the test images 1061 (FIG. 5) by the image density sensor 117 to the printer controller 300. Likewise, the engine control unit 102 transmits the result of reading gradation correction patterns (pattern images) 1104 (FIG. 7) by the line sensors 138 and 139 to the printer controller 300. The engine control unit 102 includes a Central Processing Unit (CPU).

The printer controller 300 includes a host interface (I/F) unit 302, a panel I/F unit 312, a reader I/F unit 313, an engine I/F unit 319, and an input/output buffer 303. The host I/F unit 302 is a communication interface between the printer controller 300 and the host computer 301. The panel I/F unit 312 is a communication interface between the printer controller 300 and the operation panel 180. The reader I/F unit 313 is a communication interface between the printer controller 300 and the reading device 400. The engine I/F unit 319 is a communication interface between the printer controller 300 and the printer 101. The input/output buffer 303 is a temporary storage area used to transmit and receive control codes and data via the above-described interfaces.

The printer controller 300 includes a CPU 314, an image processor 200, a program Read Only Memory (ROM) 304, and a Random Access Memory (RAM) 310. The CPU 314 executes a computer program stored in the program ROM 304 to control the operation of the printer controller 300. The RAM 310 provides a work area used by the printer controller 300 to perform processing. The RAM 310 includes a table storage unit 311 that stores a γLUT, an International Color Consortium (ICC) profile, and a density conversion table (described below).

The image processor 200 includes a Raster Image Processor (RIP) unit 315, a color processing unit 316, a gradation correction unit 317, and a pseudo-halftone processing unit 318. The RIP unit 315 rasterizes an image object (image data) into a bitmap image. The color processing unit 316 subjects the image data rasterized into a bitmap image by the RIP unit 315 to multinary color conversion processing based on the ICC profile. The gradation correction unit 317 subjects the image data having been subjected to the color conversion processing by the color processing unit 316 to monochromatic gradation correction processing, by using the γLUT. The γLUT is an example of a conversion condition for converting the image data. The pseudo-halftone processing unit 318 subjects the image data having been subjected to the gradation correction by the gradation correction unit 317 to pseudo-halftone processing including a dither matrix and an error diffusion method. The image data having been subjected to the pseudo-halftone processing by the pseudo-halftone processing unit 318 is transmitted to the printer 101 via the engine I/F unit 319. The engine control unit 102 of the printer 101 performs image forming processing based on the image data acquired from the engine I/F unit 319.

The above-described units of the printer controller 300 are connected to a system bus 320, and are capable of communicating with each other via the system bus 320. Via the system bus 320, the CPU 314 updates the ICC profile, the γLUT, and the density conversion table used during image formation. The CPU 314 reflects the latest table to the color processing unit 316 and the gradation correction unit 317 to output an image of a desired color.

(γLUT)

Figure 4:
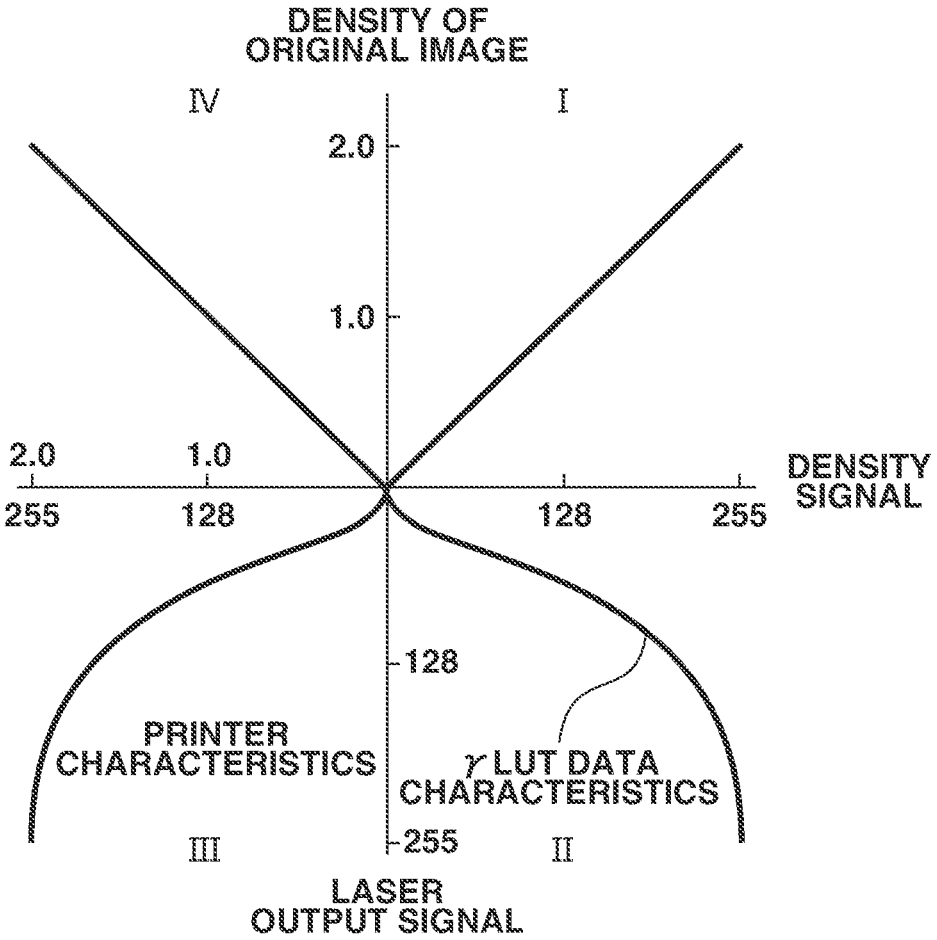
FIG. 4 is a four-quadrant chart illustrating a state where the gradation of an output image is corrected.

FIG. 4 is a four-quadrant chart illustrating a state where gradations are reproduced. The first quadrant represents the relation between the density of an image to be printed (original image) and the input value of the image data (density signal) representing the image. The second quadrant represents the transfer characteristics (data characteristics) for converting the density signal into a laser output signal indicating the light quantity of the laser beam output from the laser scanner 107. The third quadrant represents the gradation characteristics (printer characteristics) of the printer 101 indicating the relation between the laser output signal and the density of the image formed on the sheet 110 (image density). The fourth quadrant represents the relation between the density of the original image and the density of the image formed on the sheet 110 (image density). The image forming apparatus 100 generates a γLUT for adjusting the data characteristics of the second quadrant to achieve the ideal relation (linear relation) between the density of the original image and the image density. In the image forming apparatus 100, a γLUT is generated for each color and then stored in the RAM 310.

The gradation correction unit 317 converts image data (laser output signal) based on the γLUT. The converted image data is converted into a pulse signal corresponding to the dot width by a pulse width modulation (PWM) circuit of the laser driver and then transmitted to the laser driver that drives and controls the laser scanner 107. When the dot area is changed by the laser scanner 107, an electrostatic latent image having desired gradation characteristics is formed on the photosensitive drum 105. The electrostatic latent image is developed to be a visible toner image.

The test images 1061 formed on an intermediate transfer member 106 will be described below with reference to FIG. 5. FIG. 5 is a schematic view illustrating the test images 1061 for respective colors formed on the intermediate transfer member 106 between user images based on the image data transferred from the host computer 301 (or the reading device 400). The test images 1061 are formed on the intermediate transfer member 106 at such positions that the test images 1061 pass through detection positions of the image density sensor 117 by the rotation of the intermediate transfer member 106. Thus, four image density sensors 117 are arranged in a direction perpendicularly intersecting the rotational direction of the intermediate transfer member 106.

The test images 1061 include a plurality of measuring images having different gradation values for respective colors. Two measuring images are formed between images formed on different pages. The test images 1061 according to the present exemplary embodiment include measuring images having 10 different gradation values. For example, the 10 gradation values are 0, 16, 32, 64, 86, 104, 128, 176, 224, and 255. Thus, measuring images having the gradation values 0 and 16 are formed between the user images on pages N and N+1, and measuring images having the gradation values 32 and 64 are formed between the user images on pages N+1 and N+2. Then, when the user image on page N+4 has been formed, measuring images having the gradation values 244 and 255 are formed. Thus, each time user images for five pages are formed, the image forming apparatus 100 acquires the measurement data of the measuring images for 10 gradations again. The measurement data of the measuring images for 10 gradations is used to adjust the exposure intensity and generate a γLUT.

Subsequently, the test images (gradation correction patterns) 1104 formed on the sheet 110 will be described below with reference to FIG. 7.

Figure 7:
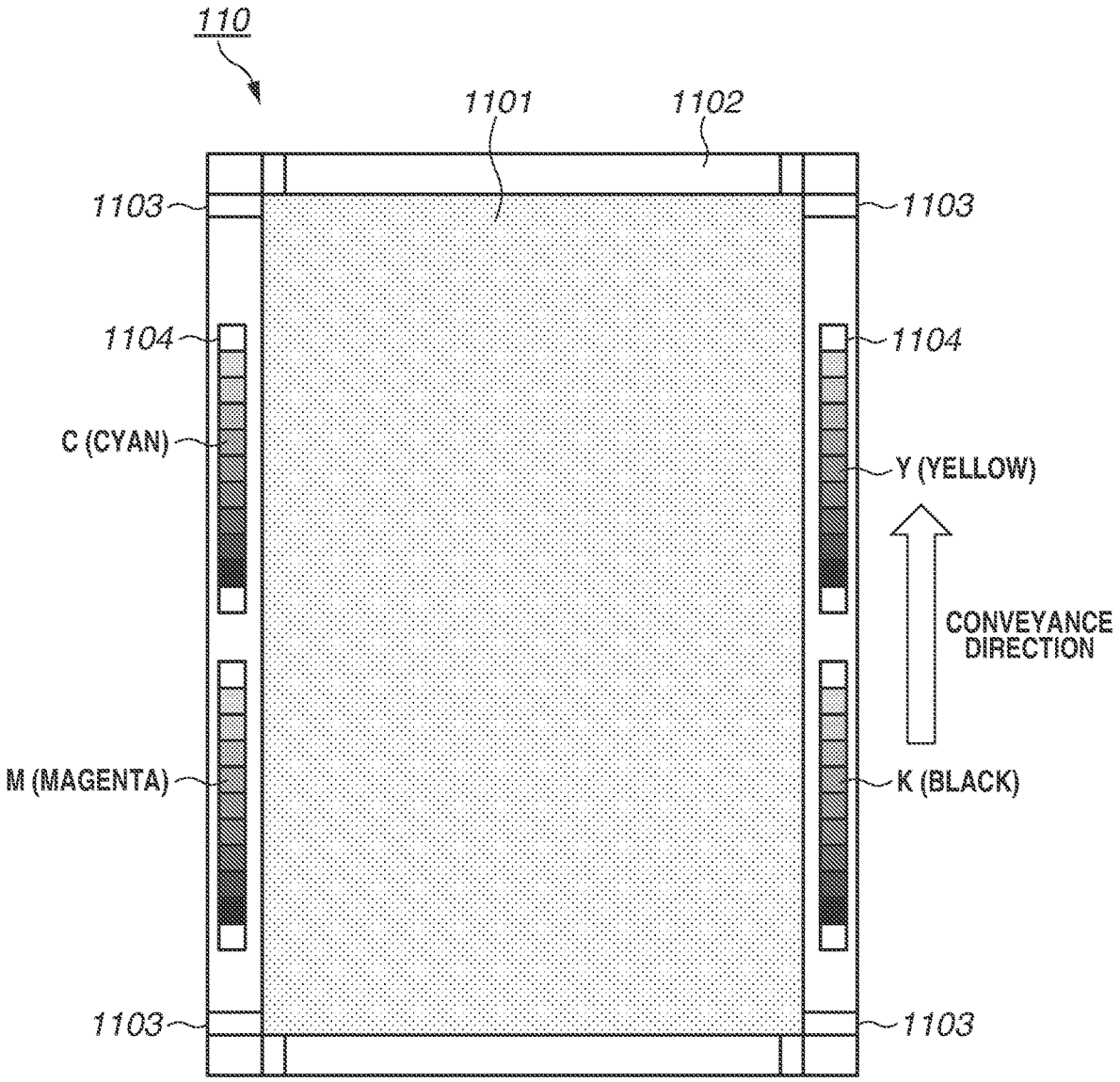
FIG. 7 is a schematic view illustrating a user image and gradation correction patterns formed on a sheet.

FIG. 7 is a schematic view illustrating the test images 1104 for respective colors formed on the sheet 110 while user images based on the image data transferred from the host computer 301 (or the reading device 400) are formed. The test images 1104 on the sheet 110 are read by the line sensor 138 (or 139) at the read position on the conveyance path 201.

The sheet 110 is conveyed in the direction of the arrow (conveyance direction) illustrated in FIG. 7. The gradation correction patterns 1104 formed on the sheet 110 are formed in edge regions (non-image regions 1102) of the sheet 110 in the conveyance direction. Referring to FIG. 7, an image region 1101 on the sheet 110 where user images are formed is shaded by dots. The sheet 110 is supplied with cutting marks 1103 in advance. The cutting marks 1103 are provided at the four corners of the image region 1101. Each of the cutting marks 1103 is constituted of two L-shaped marks combined together. The sheet 110 is cut with reference to the cutting marks 1103.

The gradation correction patterns 1104 are formed for respective colors on one surface of the sheet 110. The gradation correction patterns 1104 are formed in both edge regions of the sheet 110 in the direction perpendicularly intersecting with the conveyance direction of the sheet 110. The gradation correction patterns 1104 of two colors are formed in one edge region of the sheet 110, and the gradation correction patterns 1104 of the other two colors are formed in the other edge region of the sheet 110. Each of the gradation correction patterns 1104 is formed of a plurality of measuring images having gradually differentiated gradation values (10 gradations in FIG. 7) for each color. The plurality of measuring images, each of which has a square shape having a side of about 8 mm, is arranged on a line in the conveyance direction.

The measuring images for each color are formed so that measuring images (having the gradation value 0) for detecting the marker tone of the sheet 110 sandwiches other measuring images in the conveyance direction of the sheet 110. Nine measuring images having different gradation values are disposed between the gradation patches having the gradation value 0. In a case where the gradation value is represented by 0 to 255, each of the gradation correction patterns 1104 includes measuring images having the gradation values 0, 16, 32, 64, 86, 104, 128, 176, 224, and 255 for each color. This enables the image forming apparatus 100 to acquire measurement data of the measuring images for 10 gradations each time one sheet 110 passes through the read position of the line sensor 138 (or 139). The measurement data of the measuring images for 10 gradations is used to adjust the exposure intensity and generate a γLUT.

Conversion processing for the measurement result of the line sensor 138 (or 139) will be described below.

The image forming apparatus 100 acquires a density value A from the reading result of the line sensor 138 (or 139) and converts the density value A into the image density detected by the image density sensors 117 based on the density conversion table. This is because the density value A acquired from the measurement result of the line sensor 138 (or 139) is different from the density value acquired from the measurement result of the image density sensors 117. The image on the sheet 110 is affected by transfer processing and fixing processing in comparison with the image on the intermediate transfer member 106. Thus, if the target density of the image on the sheet 110 is the same as the target density of the image on the intermediate transfer member 106, the image density may not possibly be controlled with high accuracy.

Thus, the image forming apparatus 100 according to the present exemplary embodiment performs control so that the image density read by the line sensor 138 (or 139) after the conversion and the image density detected by the image density sensors 117 have the same target density. This configuration eliminates the need of separately setting the target density, preventing the image density control from becoming complicated.

Figure 8:
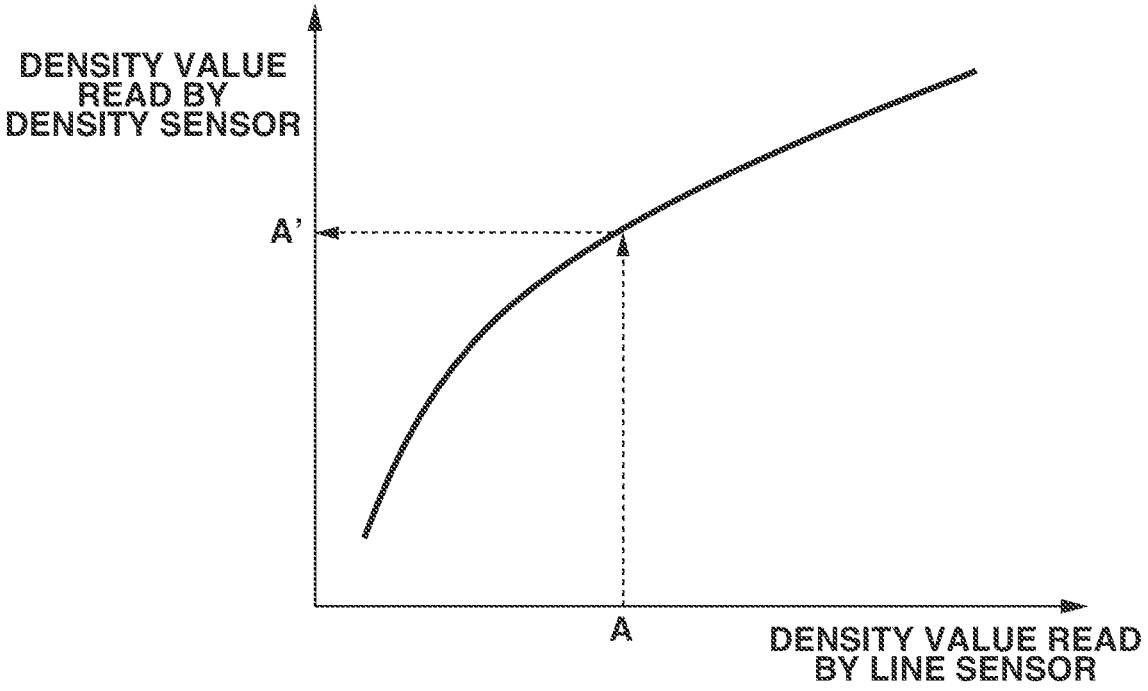
FIG. 8 is a schematic view illustrating a density conversion table.

FIG. 8 is a schematic view illustrating a density conversion table for converting the result (density value) of reading the gradation correction patterns 1104 on the sheet 110 by the line sensor 138 into the result (density value) of measuring the gradation correction patterns 1104 by the image density sensors 117. The density value A acquired from the reading result by the line sensor 138 is converted into a density value A' acquired from the measurement result by the image density sensors 117 based on the density conversion table. The density conversion table is prestored in the table storage unit 311.

Figure 6:
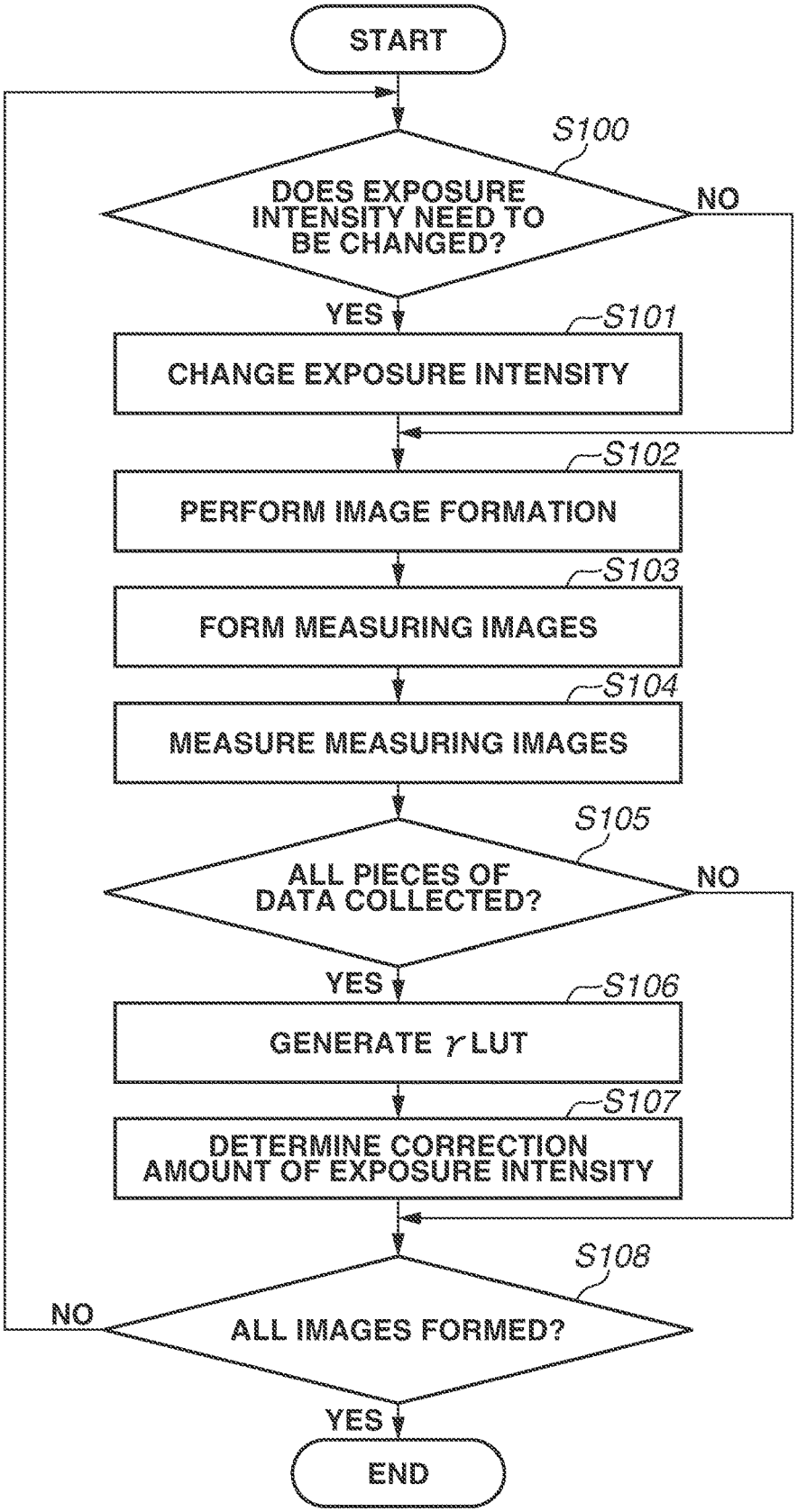
FIG. 6 is a flowchart illustrating image density control.

The image density control performed by the CPU of the engine control unit 102 and the CPU 314 of the printer controller 300 in a collaborative way will be described below with reference to the flowchart in FIG. 6. The printer controller 300 instructs the engine control unit 102 to start the image forming operation when image data for printing is input via the host I/F unit 302. After the image data representing the user image has been subjected to each piece of image processing by the image processor 200, the image data is transferred to the engine control unit 102.

Firstly, in step S100, the engine control unit 102 determines whether to change the exposure intensity. The exposure intensity for forming a user image and the gradation correction patterns 1104 is different from the exposure intensity for forming the test images 1104. As the exposure intensity for forming a user image and the gradation correction patterns 1104, the exposure intensity last used to form the test images 1061 for 10 gradations is used. On the other hand, as the exposure intensity for forming the test images 1061, the exposure intensity last corrected based on the result of measuring the test images 1061 for 10 gradations and the result of reading the gradation correction patterns 1104 stored in the RAM 310 is used. The processing is intended to prevent mismatching between the latest γLUT and the exposure intensity to be used to form a user image. Processing for determining a correction amount of the exposure intensity will be described in detail below.

In step S100, when the correction amount is other than 0 in the processing for determining the correction amount of the exposure intensity, the engine control unit 102 determines that the exposure intensity for forming the test images 1061 needs to be changed. As the exposure intensity for forming a user image and the gradation correction patterns 1104, the exposure intensity last used to form the test images 1061 is used. When the exposure intensity needs to be changed (YES in step S100), the processing proceeds to step S101. In step S101, the engine control unit 102 changes the exposure intensity for forming the test images 1061 based on the correction amount.

In step S102, the engine control unit 102 instructs the printer 101 to form a user image and the gradation correction patterns 1104 based on the image data having been subjected to the image processing by the image processor 200. Thus, the gradation correction patterns 1104 and the test images 1061 are formed while the printer 101 is continuously forming a plurality of images on a plurality of sheets 110. Each time the sheet 110 with the gradation correction patterns 1104 formed thereon reaches the read position of the line sensor 138 (or 139), the engine control unit 102 acquires the reading result of the line sensor 138 (or 139) (read data). Then, the engine control unit 102 transmits the result of reading the gradation correction patterns 1104 (read data) to the printer controller 300.

In step S103, the engine control unit 102 instructs the printer 101 to form the test images 1061 based on the measuring image data so that the test images 1061 are formed in a region between the user image formed in step S102 and the user image formed on the following page. Each time images for one page are formed, the image forming apparatus 100 according to the present exemplary embodiment forms two measuring images for each color. The printer controller 300 sequentially selects two pieces of measuring image data for forming the test images 1061 from the above-described gradation values (0, 16, 32, 48, 64, 86, 104, 128, 176, 224, and 255). The printer controller 300 instructs the gradation correction unit 317 to convert the measuring image data based on the γLUT and then transfers the converted measuring image data to the engine control unit 102. The engine control unit 102 instructs the image forming units 120, 121, 122, and 123 to form the test images 1061 on the intermediate transfer member 106 based on the measuring image data acquired from the printer controller 300.

In step S104, at the timing when the measuring images of the test images 1061 reach the measurement positions of the image density sensors 117, the engine control unit 102 controls the image density sensors 117 to measure the measuring images. The engine control unit 102 transfers the result of measuring the test images 1061 by the image density sensors 117 to the printer controller 300 as measurement data.

The CPU 314 of the printer controller 300 stores the transferred measurement data in the RAM 310. In step S105, the CPU 314 determines whether the measurement data for 10 gradations has been collected. The CPU 314 does not correct the gradation correction table before the measurement data for 10 gradations has been collected in step S105. In this case (NO in step S105), the processing proceeds to step S108.

In step S105, the CPU 314 determines that the measurement data has been collected each time the measurement data of the test images 1061 having the gradation value 255 is acquired. This processing is intended to prevent the exposure intensity from being changed during measurement of the test images 1061 for 10 gradations. To prevent the image density from being controlled based on the measurement data of the test images having different exposure intensities, the CPU 314 determines that the measurement data has not been collected until the acquisition of the measurement data related to the measuring image having the gradation value 255, which is last formed among the test images 1061.

When the measurement data for 10 gradations has been collected (YES in step S105), the processing proceeds to step S106. In step S106, the CPU 314 generates a gradation correction table based on the measurement data. In step S107, the CPU 314 determines the correction amount of the exposure intensity based on the result of measuring the measuring images having the gradation value 255. In step S105, the CPU 314 also determines whether the result of reading the gradation correction patterns 1104 (read data) is stored in the RAM 310. This is because the timing when the sheet 110 reaches the read position of the line sensor 138 (or 139) is later than the timing when the test images on the intermediate transfer member 106 reach the detection positions of the image density sensors 117. Thus, in step S105, when the measurement data for 10 gradations has been collected and the result of reading the gradation correction patterns 1104 (read data) is stored in the RAM 310, the processing proceeds to step S106. The method for generating a gradation correction table and the method for determining the correction amount of the exposure intensity will be described in detail below.

In step S108, the engine control unit 102 determines whether all images based on the image data have been formed. When all images have not been formed (NO in step S108), the processing returns to step S100.

The timing when the engine control unit 102 changes the exposure intensity is made different from the timing when the γLUT is updated. This is because changing the exposure intensity after a γLUT is generated based on the density of the test images 1061 causes a mismatch between the exposure intensity and the γLUT. Changing the exposure intensity and the γLUT at the same time disables suitable control of the image density. Thus, once a γLUT is generated based on the density of the test images 1061 for 10 gradations, the γLUT is updated for the image formed next, and the exposure intensity is changed only when the test images 1061 are formed.

Thus, the exposure intensity for forming a user image and the gradation correction patterns 1104 is different from the exposure intensity for forming the test images 1061. As the exposure intensity for forming a user image and the gradation correction patterns 1104, the exposure intensity last used when the test images 1061 for 10 gradations are formed is used. As the exposure intensity for forming the test images 1061, the exposure intensity corrected based on the result of measuring the test images 1061 for 10 gradations and on the result of reading the gradation correction patterns 1104 stored in the RAM 310 is used.

The exposure intensity is not changed during measurement of the test images 1061 for 10 gradations. If a γLUT is generated based on the result of measuring the test images 1061 having different gradation values by using different exposure intensities, the γLUT cannot be suitably generated. Thus, the density of the output image will be deviated from the targeted value. For this reason, to prevent a γLUT from being generated based on the density values of the test images 1061 formed by using different exposure intensities, the CPU 314 leaves the exposure intensity unchanged until the measurement data for 10 gradations has been collected.

The descriptions will be provided referring back to the flowchart. When all images have been formed (YES in step S108), the engine control unit 102 completes the image forming processing including the image density control.

A method for generating the exposure intensity and a γLUT based on the density read by the image density sensors 117 and the line sensor 138 (or 139) will be described. The CPU 314 acquires the density value A from the gradation correction patterns 1104 on the sheet 110. The CPU 314 stores density values A acquired from the gradation correction patterns 1104 on a plurality of the sheets 110, in the RAM 310. On the other hand, each time the images for five pages are formed, the measurement data for 10 gradations of the test images 1061 is acquired. Thus, each time the measurement data for 10 gradations of the test images 1061 is collected, the CPU 314 reads a plurality of density values A acquired from the gradation correction patterns 1104 formed based on the previous γLUT, from the RAM 310. Then, the CPU 314 acquires the average density of the plurality of density values A, converts the average value of the density values A into a density value A' based on the density conversion table, and combines the density value A' and a density value B to acquire the gradation characteristics (density characteristics) of the printer 101. The CPU 314 determines the correction amount of the exposure intensity and generates a γLUT so that the gradation characteristics (density characteristics) become the ideal gradation characteristics.

The CPU 314 calculates a combined density C based on the density values A and B acquired by the image density sensors 117 and the line sensor 138 (or 139) by using Formula (1).

$$C(i)=Fa(i)*A'(i)+Fb(i)*B(i) \quad \text{Formula (1)}$$

In the formula, i denotes the number of the measuring image. Specifically, i=1 corresponds to the gradation value 0, and i=10 corresponds to the gradation value 255. Fa and Fb denote feedback coefficients as determination conditions. A' denotes a density value obtained from the reading result of the line sensor 138 (or 139) and then converted based on the density conversion table. B denotes a density value obtained from the measurement result of the image density sensors 117.

As the feedback coefficients in Formula (1), results of dividing the values of the table illustrated in FIG. 9A by 100 are used. Each value of the table illustrated in FIG. 9A is a feedback rate that represents a feedback coefficient in percentage. Since the line sensor 138 (or 139) reads the toner image after fixing, the reading result of the line sensor 138 (or 139) is affected by the thickness and color of the sheet 110. Thus, in the combined density C, the feedback coefficient Fa(i) of the low-density region is made smaller than the feedback coefficient Fa(i) of the high-density region. On the other hand, the toner image after the fixing is read as the density of the product. Thus, in the combined density C, the feedback coefficient Fa(i) of the high-density region is made larger than the feedback coefficient Fa(i) of the low-density region. Thus, the CPU 314 calculates the combined density C based on the densities read by the image density sensors 117 and the line sensor 138 with reference to Formula (1) and Table 1.

Figure 10:
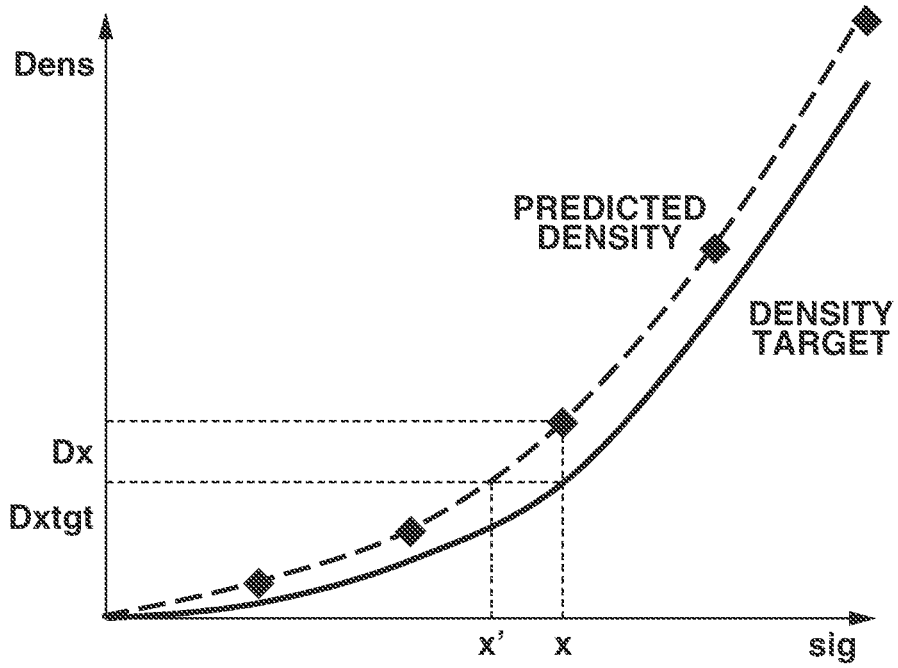
FIG. 10 illustrates a concept of generating a γ lookup table (LUT).

FIG. 10 illustrates a concept used by the CPU 314 to generate a γLUT. The horizontal axis represents the gradation value (image signal value), and the vertical axis represents the density value. The solid line denotes the ideal gradation characteristics that represents a corresponding relation between the image signal and the target density. The broken line denotes the actual gradation characteristics calculated based on the combined density C for 10 gradations by linear interpolation. To convert a density Dx of an image signal value x into a target density Dxtgt, the image signal value x needs to be converted into an image signal value xtgt corresponding to the target density Dxtgt of the image signal value x. The CPU 314 generates a table for converting the image signal value x into the image signal value xtgt, as a γLUT.

A method for determining the correction amount of the exposure intensity illustrated in step S107 in FIG. 6 will be described below. The CPU 314 determines the correction amount of the exposure intensity based on a difference between a combined density C10 having the gradation value 255 and a target density C10*tgt*. In the following descriptions, a smaller numerical value of the combined density C10 denotes a lower density, and a larger numerical value of the combined density C10 denotes a higher density.

When the combined density C10 is lower than a lower-limit value, the CPU 314 increases the exposure intensity by two levels.

More specifically, the correction amount of the exposure intensity is +2. When the exposure intensity increases by two levels, the intensity of the laser beam emitted from the laser scanner 107 increases to increase the density of the image formed on the photosensitive drum 105. On the other hand, when the combined density C10 is higher than an upper-limit value, the CPU 314 decreases the exposure intensity by two levels. More specifically, the correction amount of the exposure intensity is −2. When the exposure intensity decreases by two levels, the intensity of the laser beam emitted from the laser scanner 107 decreases to decrease the density of the image formed on the photosensitive drum 105.

When the combined density C10 is higher than the lower-limit value and lower than a low-density threshold value, the CPU 314 increases the exposure intensity by one level. More specifically, the correction amount of the exposure intensity is +1. When the combined density C10 is lower than the upper-limit value and higher than a high-density threshold value, the CPU 314 decreases the exposure intensity by one level. When the combined density C10 is higher than the low-density threshold value and lower than the high-density threshold value, the CPU 314 performs control to leave the exposure intensity unchanged.

As described above, the gradation correction patterns 1104 are formed in the non-image regions 1102 on the sheet 110. Thus, the image forming apparatus 100 according to the first exemplary embodiment enables controlling the density of images formed by the image forming apparatus 100 with high accuracy. The image forming apparatus 100 according to the first exemplary embodiment further enables maintaining the suitable gradation characteristics without stopping a print job for gradation correction.

(Modification)

As the feedback coefficients for calculating the above-described combined density, a different value for each gradation value is used. The feedback coefficient Fa for the low-density region is lower than the feedback coefficient Fa for the high-density region. However, the feedback coefficients Fa and Fb are not limited to the values of the table in FIG. 9A. For example, as the feedback coefficients Fa and Fb, results of dividing the values of the table illustrated in FIG. 9B by 100 may be used. Each value of the table illustrated in FIG. 9B is also a feedback rate that represents a feedback coefficient in percentage.

As illustrated in FIG. 9B, the feedback coefficient Fa is higher than the feedback coefficient Fb regardless of the gradation value. This represents a concept of making the influence of the density value A higher than the influence of the density value B because the density value A acquired from the measurement result by the line sensor 138 (or 139) is closer to the density of the product than the density value B acquired from the measurement result by the image density sensors 117.

The image forming apparatus 100 according to a modification of the first exemplary embodiment enables controlling the density of images formed by the image forming apparatus 100, with high accuracy. Further, in the image formation according to the modification, the image forming apparatus 100 enables maintaining the suitable gradation characteristics without stopping a print job for gradation correction.

The image forming apparatus 100 according to the first exemplary embodiment is configured to update the exposure intensity and the γLUT each time the measurement data of the test images 1061 on the intermediate transfer member 106 has been collected for 10 gradations. However, in the above-described configuration, the test images 1061 are formed for 2 gradations between a plurality of user images, resulting in the degraded productivity of the image forming apparatus 100. Thus, there has been considered a configuration in which the test images 1061 are formed for each gradation value between the plurality of user images. Although, in this case, the productivity of the image forming apparatus 100 increases in comparison with the first exemplary embodiment, it takes twice as long to collect the measurement data for 10 gradations. Thus, the exposure intensity and the γLUT update frequency decrease, possibly making it impossible to stabilize the image density with high accuracy.

Accordingly, the image forming apparatus 100 according to a second exemplary embodiment generates the exposure intensity and a γLUT when the measurement data of the gradation correction patterns 1104 has been collected for five sheets. If the exposure intensity and a γLUT are generated when the measurement data of the gradation correction patterns 1104 has been collected for five sheets, the image forming apparatus 100 according to the present exemplary embodiment provides higher productivity and stabilizes the image density with higher accuracy than the image forming apparatus 100 according to the first exemplary embodiment.

Figure 11:
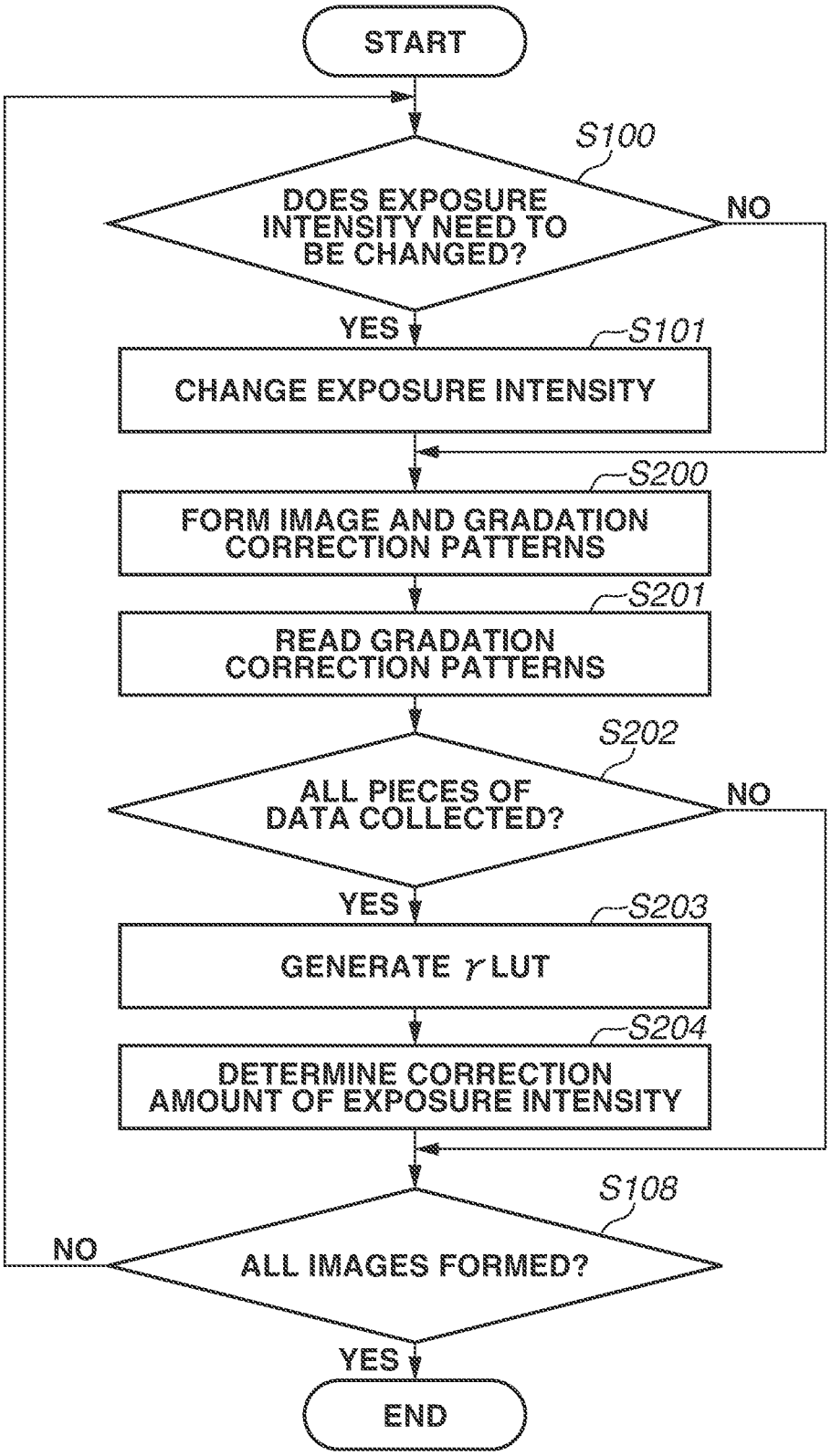
FIG. 11 is a flowchart illustrating image density control according to another exemplary embodiment.

The image density control according to the present exemplary embodiment performed by the CPU of the engine control unit 102 and the CPU 314 of the printer controller 300 in a collaborative way will be described below with reference to the flowchart in FIG. 11. In the flowchart in FIG. 11, processing in steps S100, S101, and S108 is similar to that of the flowchart in FIG. 6, and the descriptions thereof will be omitted. While images for five pages are being formed on the intermediate transfer member 106, the test images 1061 are formed for each gradation value between images formed on each page, and the result of measuring the test images 1061 by the image density sensors 117 is notified to the printer controller 300. The result of measuring the test images 1061 is stored in the RAM 310.

In step S200, the engine control unit 102 instructs the printer 101 to form a user image and the gradation correction patterns 1104 on the same sheet 110. Although omitted in the flowchart in FIG. 11, while the printer 101 according to the present exemplary embodiment is continuously forming a plurality of images on a plurality of the sheets 110, the printer 101 forms not only the gradation correction patterns 1104 but also the test images 1061.

Then, the sheet 110 with the user image and the gradation correction patterns 1104 formed thereon is conveyed to the line sensor 138 (or 139). In step S201, the engine control unit 102 instructs the line sensor 138 (or 139) to read the gradation correction patterns 1104. The reading result of the line sensor 138 (or 139) is notified to the printer controller 300. The CPU 314 of the printer controller 300 obtains the density value A from the reading result, and converts the density value A into a density value A' based on a density conversion table LUT 1.

In step S202, the CPU 314 determines whether density values A' of the gradation correction patterns 1104 have been collected for five sheets. When the density values A' of the gradation correction patterns 1104 have been collected for five sheets (YES in step S202), the processing proceeds to step S203. In step S203, the CPU 314 generates a γLUT based on the average value of the density values A' of the gradation correction patterns 1104 for five sheets without using the result of measuring the test images 1061. In the present exemplary embodiment, the test images 1061 are formed for each gradation value to improve the productivity of the image forming apparatus 100. Thus, if the γLUT is not updated until the measurement data of the test images 1061 for 10 gradations has been collected, the image density may possibly be deviated from the target density. To generate a γLUT at a high frequency, the CPU 314 generates a γLUT each time the measurement data of the gradation correction patterns 1104 is collected for five sheets without using the measurement data of the test images 1061.

In step S204, the CPU 314 determines the correction amount of the exposure intensity based on the average value of the latest density value B having the gradation value 255 stored in the RAM 310 and the density value A' having the gradation value 255. The measurement data of the test images 1061 is not used in generating a γLUT in step S203. However, the correction amount of the exposure intensity is determined based on both the measurement data of the test images 1061 and the measurement data of the gradation correction patterns 1104. This is because the exposure intensity has a smaller influence on the image density than the γLUT. If the γLUT is determined with highly accuracy, density variations caused by an exposure intensity deviation can be prevented. Thus, when determining the correction amount of the exposure intensity, the image forming apparatus 100 according to the present exemplary embodiment uses both the measurement data of the test images 1061 and the measurement data of the gradation correction patterns 1104.

The exposure intensity determination method according to the present exemplary embodiment will be described below. The CPU 314 sums up the value obtained by multiplying the density value A' of the gradation correction patterns 1104 having the gradation value 255 by the feedback coefficient 0.7 and the value obtained by multiplying the density value B of the test images 1061 having the gradation value 255 by the feedback coefficient 0.3. The total value is equivalent to the combined density C. Then, similar to the exposure intensity determination method according to the first exemplary embodiment, the CPU 314 determines the correction amount of the exposure intensity by comparing the combined density C with a plurality of threshold values.

Thus, the image forming apparatus 100 according to the second exemplary embodiment enables controlling the density of images formed by the image forming apparatus 100, with high accuracy.

The image forming apparatuses 100 according to the first and second exemplary embodiments form the gradation correction patterns 1104 in the regions to be cut off (edge regions 1102) of the sheet 110. The mode is referred to as a real-time mode. However, there may be a case where an image is formed without using the sheet 110 having the edge regions 1102 where the gradation correction patterns 1104 can be formed.

In this case, the image forming apparatus 100 can control the image density by forming the gradation correction patterns 1104 on the sheet 110 for every predetermined number of sheets specified in advance and then reading the gradation correction patterns 1104 by the line sensor 138 (or 139). The mode is referred to as an interrupt mode. In the interrupt mode, no user image is formed on the sheet 110 where the gradation correction patterns 1104 are formed.

However, if the specified number of sheets is too small in the interrupt mode, the image forming apparatus 100 will consume a large number of sheets 110 to form the gradation correction patterns 1104. Thus, it is assumed that the specified number of sheets is set to 20 or more. This may increase the interval of forming the gradation correction patterns 1104, possibly degrading the stability of the image density. Thus, when the real-time mode is executed, the image forming apparatus 100 according to a third exemplary embodiment controls the image density in a similar way to the second exemplary embodiment, and when the interrupt mode is executed, the image forming apparatus 100 generates a γLUT based on the density value B of the test images 1061.

Density control according to the present exemplary embodiment will be described below. Each time user images are formed for five pages, the CPU 314 can acquire the measurement data of the test images 1061 for 10 gradations.

When the measurement data for 10 gradations has been acquired, the CPU 314 generates a γLUT based on the measurement data of the test images 1061 without using the measurement data of the gradation correction patterns 1104.

In the interrupt mode, the CPU 314 determines the correction amount of the exposure intensity based on the average value of the density value B having the gradation value 255 and the latest density value A' having the gradation value 255 stored in the RAM 310. Although the measurement data of the gradation correction patterns 1104 is not used in generating a γLUT, the correction amount of the exposure intensity is determined based on both the measurement data of the test images 1061 and the measurement data of the gradation correction patterns 1104. This is because the exposure intensity has a smaller influence on the image density than the γLUT. If the γLUT is determined with high accuracy, density variations caused by an exposure intensity deviation can be prevented. Thus, when determining the correction amount of the exposure intensity, the image forming apparatus 100 according to the present exemplary embodiment uses both the measurement data of the test images 1061 and the measurement data of the gradation correction patterns 1104.

The exposure intensity determination method according to the present exemplary embodiment will be described below. When the density value A' of the gradation correction patterns 1104 having the gradation value 255 is lower than 1.6, the CPU 314 determines the correction amount of the exposure intensity based on the density value B of the test images 1061 having the gradation value 255, based on the correction amount determination table T1. On the other hand, when the density value A' of the gradation correction patterns 1104 having the gradation value 255 is higher than 1.75, the CPU 314 determines the correction amount of the exposure intensity based on the density value B of the test images 1061 having the gradation value 255, based on a correction amount determination table T2. When the density value A' of the gradation correction patterns 1104 having the gradation value 255 is higher than or equal to 1.6 and lower than 1.75, the CPU 314 determines the correction amount of the exposure intensity based on the density value B of the test images 1061 having the gradation value 255, based on a correction amount determination table T0. The correction amount determination tables T1, T2, and T0 are equivalent to other determining conditions for determining the correction amount. The correction amount determination tables T1, T2, and T0 are illustrated in FIG. 12.

As described above, the image forming apparatus 100 according to the third exemplary embodiment enables controlling the density of images formed by the image forming apparatus 100, with high accuracy.

(Modification)

The image forming apparatus 100 according to the third exemplary embodiment changes the correction amount determination table for determining the correction amount based on the density value A' detected in the interrupt mode. However, when the interrupt mode is executed, the CPU 314 may determine the correction amount of the exposure intensity based on the combined density C having the gradation value 255, based on the correction amount determination table T0.

In this case, the CPU 314 sums up the value obtained by multiplying the density value A' of the gradation correction patterns 1104 having the gradation value 255 by the feedback coefficient 0.3 and the value obtained by multiplying the density value B of the test images 1061 having the gradation value 255 by the feedback coefficient 0.7. The total value is equivalent to the combined density C. Then, similar to the exposure intensity determination method according to the first exemplary embodiment, the CPU 314 determines the correction amount of the exposure intensity by comparing the combined density C with a plurality of threshold values.

As described above, the image forming apparatus 100 according to a modification of the third exemplary embodiment enables controlling the density of images formed by the image forming apparatus 100, with high accuracy.

As described above, the image forming apparatus 100 according to the present specification enables controlling the density of images formed by the image forming apparatus 100, with high accuracy, based on both the measurement result of the line sensor 138 (or 139) and the measurement result of the image density sensors 117.

The image forming apparatus 100 according to the present specification determines the correction amount of the exposure intensity based on the density value A of the gradation correction patterns 1104 having the gradation value 255 and the density value B of the test images 1061 having the gradation value 255. However, the gradation values of a first measuring image and a second measuring image for determining the correction amount of the exposure intensity are not limited to the above-described values. For example, the correction amount may be determined based on the density value of the gradation correction patterns 1104 having the gradation value 244 and the density value of the test images 1061 having the gradation value 244. The gradation values do not need to be identical. For example, the correction amount may be determined based on the density value of the gradation correction patterns 1104 having the gradation value 255 and the density value of the test images 1061 having the gradation value 128.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-089702, filed May 28, 2021, which is hereby incorporated by reference herein in its entirety.

What is claimed is:

1. An image forming apparatus comprising:

an image carrier;

an image forming unit configured to form an image on the image carrier;

a transfer unit configured to transfer the image from the image carrier to a sheet;

a reader configured to read a pattern image on the sheet while conveying the sheet;

a sensor configured to measure a measuring image on the image carrier; and a controller configured to:

control the image forming unit to form the pattern image and the measuring image while forming a plurality of images on a plurality of sheets, control the reader to read the pattern image, control the sensor to measure the measuring image, generate an image forming condition based on a result of reading the pattern image by the reader and a result of measuring the measuring image by the sensor, and control image forming by the image forming unit based on the image forming condition, wherein the measuring image is formed in a region on the image carrier between a first image included in the plurality of images and a second image following the first image included in the plurality of images.

2. The image forming apparatus according to claim 1, wherein the image forming unit comprises:

a photosensitive member;

a laser scanner configured to expose the photosensitive member to light to form an electrostatic latent image on the photosensitive member; and a developing roller configured to develop the electrostatic latent image, and wherein the controller generates a correction amount for correcting optical intensity of the laser scanner as the image forming condition.

3. The image forming apparatus according to claim 1, wherein the image forming unit comprises an image processor configured to convert image data based on a conversion condition, wherein the image forming unit forms the image based on the image data converted by the image processor, and wherein the controller generates the conversion condition as the image forming condition.

4. The image forming apparatus according to claim 1, wherein the controller determines a first value based on the result of reading the pattern image by the reader and a first feedback condition, determines a second value based on the result of measuring the measuring image by the sensor and a second feedback condition, and generates the image forming condition based on a sum of the first and the second values.

5. The image forming apparatus according to claim 1, wherein the controller generates the image forming condition each time the image is formed on a predetermined number of sheets which is larger than one.

6. The image forming apparatus according to claim 1, further comprising an image processor configured to convert image data based on a conversion condition, wherein the image forming unit forms the image based on the image data converted by the image processor, wherein the pattern image includes a first pattern image and a second pattern image having a density different from that of the first pattern image, wherein the first and the second pattern images are formed on the same sheet, wherein the controller generates the image forming condition based on a result of reading the first pattern image by the reader and the result of measuring the measuring image by the sensor, and wherein the controller generates the conversion condition based on a result of reading the second pattern image by the reader.

7. The image forming apparatus according to claim 1, further comprising an image processor configured to convert image data based on a conversion condition, wherein the image forming unit forms the image based on the image data converted by the image processor, wherein the measuring image further includes other measuring images formed in a region on the image carrier between the second image included in the plurality of images and a third image following the second image included in the plurality of images, wherein the controller generates the image forming condition based on the result of reading the pattern image by the reader and the result of measuring the measuring image by the sensor, and wherein the controller generates the conversion condition based on a result of measuring the other measuring images by the sensor.

8. The image forming apparatus according to claim 1, further comprising an image processor configured to convert image data based on a conversion condition, wherein the image forming unit forms the image based on the image data converted by the image processor, wherein the pattern image includes a first pattern image and a second pattern image having a density different from that of the first pattern image, wherein the first and the second pattern images are formed on the same sheet, wherein the measuring image further includes other measuring images formed in a region on the image carrier between the second image included in the plurality of images and a third image following the second image included in the plurality of images, wherein the controller generates the image forming condition based on a result of reading the first pattern image by the reader and the result of measuring the measuring image by the sensor, and wherein the controller executes a first mode for generating the conversion condition based on a result of reading the second pattern image by the reader and a second mode for generating the conversion condition based on a result of measuring the other measuring images by the sensor.

9. The image forming apparatus according to claim 8, wherein, when a job for forming the pattern image on the same sheet as the sheet subjected to image formation is to be executed, the controller executes the first mode, and wherein, when a job for forming the pattern image on a sheet different from the sheet subjected to the image formation is to be executed, the controller executes the second mode.

* * * * *